US007591157B2

(12) United States Patent
O'Neill et al.

(10) Patent No.: US 7,591,157 B2
(45) Date of Patent: Sep. 22, 2009

(54) SECURITY LOCK ARRANGEMENT

(75) Inventors: Daniel Maurice O'Neill, Gladesville (AU); Darren Maurice O'Neill, Dundas (AU)

(73) Assignee: Daz Lock Pty Ltd, Gladesville, NSW (AU)

( * ) Notice: Subject to any disclaimer, the term of this patent is extended or adjusted under 35 U.S.C. 154(b) by 397 days.

(21) Appl. No.: 10/595,417

(22) PCT Filed: Sep. 27, 2004

(86) PCT No.: PCT/AU2004/001325

§ 371 (c)(1),
(2), (4) Date: Apr. 17, 2006

(87) PCT Pub. No.: WO2005/038175

PCT Pub. Date: Sep. 27, 2004

(65) Prior Publication Data

US 2008/0157542 A1 Jul. 3, 2008

(30) Foreign Application Priority Data

Oct. 16, 2003 (AU) ..... 2003905640

(51) Int. Cl.
*E05B 63/14* (2006.01)

(52) U.S. Cl. ..... 70/118; 70/103; 70/107; 292/32; 292/336.3

(58) Field of Classification Search ..... 70/103, 70/104, 107–111, 118; 292/32, 37, 336.3
See application file for complete search history.

(56) References Cited

U.S. PATENT DOCUMENTS 4,068,510 A * 1/1978 Neary ..... 70/379 R
4,154,070 A * 5/1979 Bahry et al. ..... 70/108
4,470,276 A * 9/1984 Bayless ..... 70/91
4,470,277 A * 9/1984 Uyeda ..... 70/118
4,563,885 A * 1/1986 Madden ..... 70/97
4,709,566 A * 12/1987 Wildenradt ..... 70/129
5,077,992 A 1/1992 Su
5,469,723 A * 11/1995 Litwin et al. ..... 70/107

(Continued)

FOREIGN PATENT DOCUMENTS

EP 0723056 A 7/1996

(Continued)

*Primary Examiner*—Suzanne D Barrett
(74) *Attorney, Agent, or Firm*—Brooks Kushman P.C.

(57) ABSTRACT

A security lock arrangement (10) includes a carrier (40) to be mounted on a wing member. At least one latch bolt (28-34) is displaceably arranged relative to the carrier (40) between a retracted, unlocked position and an extended, locked position. An urging means (60) acts on the at least one latch bolt (28-34) for urging the latch bolt (28-34) to its extended, locked position. A drive means is mounted on the carrier (40) for driving the at least one latch bolt (28-34) at least into its retracted position against the action of the urging means (60). A displacement mechanism is interposed between the drive means and the at least one latch bolt (28-34), the displacement mechanism comprising a cam member (64) rotatably driven by the drive means, the cam member (64) acting on a follower of the at least one latch bolt (28-34), the cam member (64) having a maximum throw when the at least one latch bolt (28-34) is proximate its retracted position.

49 Claims, 8 Drawing Sheets

U.S. PATENT DOCUMENTS 5,857,364 A * 1/1999 Hsu et al. ..... 70/120
5,911,763 A * 6/1999 Quesada ..... 70/120
5,992,100 A 11/1999 Sidney
6,101,853 A 8/2000 Herr
6,176,041 B1 1/2001 Roberts
6,189,351 B1 * 2/2001 Eagan et al. ..... 70/472
6,302,456 B1 * 10/2001 Errani ..... 292/332
6,581,423 B2 * 6/2003 Lin ..... 70/107
6,669,245 B2 12/2003 Ruano Aramburu et al.
6,899,361 B2 * 5/2005 Dorn ..... 292/332
7,036,855 B2 * 5/2006 Lin et al. ..... 292/216
7,303,215 B2 * 12/2007 Moon et al. ..... 292/32
7,350,383 B1 * 4/2008 Kuo ..... 70/277
7,357,010 B1 * 4/2008 Huang et al. ..... 70/379 R

FOREIGN PATENT DOCUMENTS

EP 0723057 A 7/1996

* cited by examiner

SECURITY LOCK ARRANGEMENT

CROSS-REFERENCE TO RELATED APPLICATIONS

The present application claims priority from Provisional Patent Application No. 2003905640 filed on 16 Oct. 2003, the contents of which are incorporated herein by reference.

FIELD OF THE INVENTION

This invention relates to a security lock. More particularly, the invention relates to a security lock arrangement for securely locking a wing member in a closed position relative to a surround.

BACKGROUND TO THE INVENTION

The use of security doors is becoming increasingly important, both from a safety aspect and for inhibiting unauthorised access to premises.

Latch-type locks make use of a latch bolt that is received in a frame surrounding a wing member hingedly arranged in the frame. The wing member is, conventionally, a door or window. Typically, the latch bolt is received through a striker plate mounted on the frame and can be retracted to an unlocked position to facilitate opening of the wing member.

Such latch members normally have a slanted face. If the wing member opens inwardly, the slanted face faces outwardly and this can render it relatively easy for a determined entrant to gain entry into the premises by forcing retraction of the latch bolt.

In addition, the use of only a single latch bolt further compromises the security of such a locking arrangement.

The Applicant has previously proposed the use of a plurality of latch bolts to improve the security of a security locking arrangement. Either two such latch bolts or four such latch bolts, arranged in a cruciform fashion, are mounted on the wing member. Preferably, the latch bolts are arranged on an outer surface of an operatively inner side of the wing member and this provides the advantage that the security locking arrangement can be retrofitted to an existing door. These latch bolts are also flat ended, i.e. they do not have a slanted faces.

The use of electronic access is also becoming increasingly prevalent. In addition, the Applicant has determined that the torque required to turn a key in a key lock of a security lock, arranged on an opposite side of the wing member to a handle, can be high resulting in the possibility of the key snapping with a blade of the key remaining in a barrel of the lock.

The Applicant has also determined that, particularly, with the use of electronic access facilities, an enhanced latching mechanism is required for extending the latch bolts to their locked positions upon closure of the wing member.

SUMMARY OF THE INVENTION

According to a first aspect of the invention, there is provided a security lock arrangement which includes:

a carrier to be mounted on a wing member;

at least one latch bolt displaceably arranged relative to the carrier between a retracted, unlocked position and an extended, locked position;

an urging means acting on the at least one latch bolt for urging the latch bolt to its extended, locked position;

a drive means mounted on the carrier for driving the at least one latch bolt at least into its retracted position against the action of the urging means; and a displacement mechanism interposed between the drive means and the at least one latch bolt, the displacement mechanism comprising a cam member rotatably driven by the drive means, the cam member acting on a follower of the at least one latch bolt, the cam member having a maximum throw when the at least one latch bolt is proximate its retracted position.

According to a second aspect of the invention, there is provided a security lock arrangement which includes:

a carrier to be mounted on a wing member;

at least one latch bolt displaceably arranged relative to the carrier between a retracted, unlocked position and an extended, locked position;

an urging means acting on the at least one latch bolt for urging the latch bolt to its extended, locked position;

a displacement mechanism for displacing the at least one latch bolt at least to its retracted, unlocked position against the action of the urging means;

a holding assembly for holding the at least one latch bolt in its retracted position; and a non-contact, proximity detection unit for determining when the wing member is in its closed position relative to a surround of the wing member, the proximity detection unit, upon detecting that the wing member is closed, acting on the holding assembly to cause the holding assembly to disengage the at least one latch bolt so that the at least one latch bolt moves to its extended, locked position under the action of the urging means.

According to a third aspect of the invention, there is provided a security lock arrangement which includes:

a carrier to be mounted on a wing member;

at least one latch bolt displaceably arranged relative to the carrier between a retracted, unlocked position and an extended, locked position;

an urging means acting on the at least one latch bolt for urging the latch bolt to its extended, locked position; and an operating mechanism which acts on the at least one latch bolt to withdraw the latch bolt from its locked position to its unlocked position, the operating mechanism comprising, in combination, a handle mountable on one side of the wing member and a key lock mechanism mountable on an opposed side of the wing member, the key lock mechanism including a barrel in register with a rotational axis of the handle, the barrel and the handle being connected by a link, the link including a lost motion component to allow the barrel and the handle to operate, at least partially, independently of each other.

In a preferred form of the invention, the security lock arrangement comprises at least two latch bolts extending in opposite directions. In a most preferred form of the invention, the security lock arrangement comprises two pairs of orthogonally arranged latch bolts. In respect of each pair, the latch bolts extend in opposite directions. As previously indicated, a free end of each latch bolt is flat-ended.

The latch bolts may be arranged in a cruciform-arrangement on the wing member, which may be a door, and, when in their locked positions, project beyond edges of the door approximately mid-way along the length of each edge of the door The handle of the operating mechanism may be arranged proximate a free edge of the door, i.e. an edge of the door opposite the edge of the door carrying the hinges, on an operatively inner side of the door. The key lock mechanism may be arranged on an operatively outer side of the door.

Each latch bolt may have a carrier associated with it, each carrier being in the form of a carrier plate mountable to an operatively inner surface of the wing member. For aesthetic reasons, the carrier plates may each be covered by a cover member. At least one carrier plate may be arranged in segments to facilitate adjustment of the length of the carrier plate to cater for wing members of different sizes.

Each latch bolt may be mounted on a control arm, an operatively inner end of the control arm being pivotally secured to a rotary element arranged substantially centrally on the carrier plate. The rotary element may carry the follower, the follower being eccentrically arranged on the rotary element so that, when the cam rotates, it drives the rotary element through a predetermined arc to cause the control arms to be drawn inwardly to retract the latch bolts to their unlocked position.

The cam may be arranged so that, when the latch bolts are in their retracted position, the follower is at a position of maximum throw of the cam. A recessed region may be arranged on a surface of the cam following the position of maximum throw so that, as the cam continues to rotate, the follower moves into register with such recessed region. Thus, in use, the drive means, which may be in the form of an electric motor-gearbox combination, may drive the cam to unlock the door by retracting the latch bolts. After a delay period, which may be set by a user, the cam rotates further in the same direction. However, the latch bolts are retained in their retracted position by means of the holding means. When the proximity detection unit detects that the door is closed, the holding means may disengage from its associated latch bolt. Because all the latch bolts are interconnected by the rotary member, when the latch bolt associated with the holding means is held in its retracted position by the holding means, all the latch bolts are held in their retracted position. Conversely, when the holding means disengages from its associated latch bolt and, provided the latch bolts are not being held in their retracted position by the drive means, all the latch bolts extend to their locked position.

Preferably, the proximity detecting unit is associated with the latch bolt closest to the handle but this need not be the case. The control arm for the latch bolt associated with the proximity detection unit may be connected to the latch bolt via a positive drive arrangement. The positive drive arrangement may be in the form of a rack and pinion arrangement. Thus, the control arm may terminate in a first rack displaceably arranged relative to the carrier, teeth of the rack meshing with teeth of a pinion. A second rack may be arranged on an opposed side of the pinion to which the latch bolt is connected.

The holding assembly may be in the form of a pawl which engages a receiving formation associated with the positive drive arrangement. The pawl may be pivotally mounted on the carrier and may be biased by a coil spring into engagement with the receiving formation.

The proximity detection unit may comprise a magnetic assembly having a first magnet mounted in a wing member frame and a second magnet displaceably arranged relative to the carrier proximate a free edge of the wing member. The second magnet may be operatively associated with the pawl to act on the pawl so that, when the second magnet is attracted by the first magnet, when the wing member is in its closed position, the pawl is urged out of engagement with the receiving formation to release the latch bolts to enable the latch bolts to extend to be received in their respective striker plates under the action of the urging means.

The magnets are, preferably, high strength magnets and, more particularly, may be rare earth magnets.

The link connecting the handle and the barrel may comprise a pair of co-axially aligned spindles interconnected by an axle or pin. A first of the spindles may be connected to the handle with the second of the spindles being associated with the barrel of the lock, the pin being arranged at facing, inner ends of the spindles.

The first spindle may have a drive member on its inner end with the second spindle having a driven member on its second end on which the drive member acts. The drive member may have a drive bar extending parallel to a direction of rotation of the spindles. The drive bar may engage a bearing formation of the driven member so that, when the handle is rotated to unlock the security lock arrangement, both spindles rotate. Conversely, when the second spindle is rotated via a key inserted into the barrel of the lock, only the second spindle rotates.

The lost motion link may include a connecting formation at an outer end of the second spindle via which the barrel of the key lock is connected to the second spindle. The key lock may include a blade projecting from the barrel which is received in the connecting formation.

The connecting formation may comprise a pair of opposed, spaced slot-defining members at an outer end of the second spindle, the slot-defining members having shaped, or bevelled, surfaces so that, when the second spindle is rotated under the effect of the handle, the slot-defining members can rotate relative to the blade of the key lock without impinging on the blade but, when the key lock is used to unlock the security lock arrangement, the blade bears against the slot-defining members to cause rotation of the second spindle only.

The invention extends also to a component for a security lock arrangement, the component comprising a link for interconnecting a handle and a key lock of the security lock arrangement, the link including a lost motion component to allow the barrel and the handle to operate, at least partially, independently of each other.

BRIEF DESCRIPTION OF THE DRAWINGS

An embodiment of the invention is now described by way of example with reference to the accompanying diagrammatic drawing in which.

DETAILED DESCRIPTION OF EXEMPLARY EMBODIMENT

Figure 1:
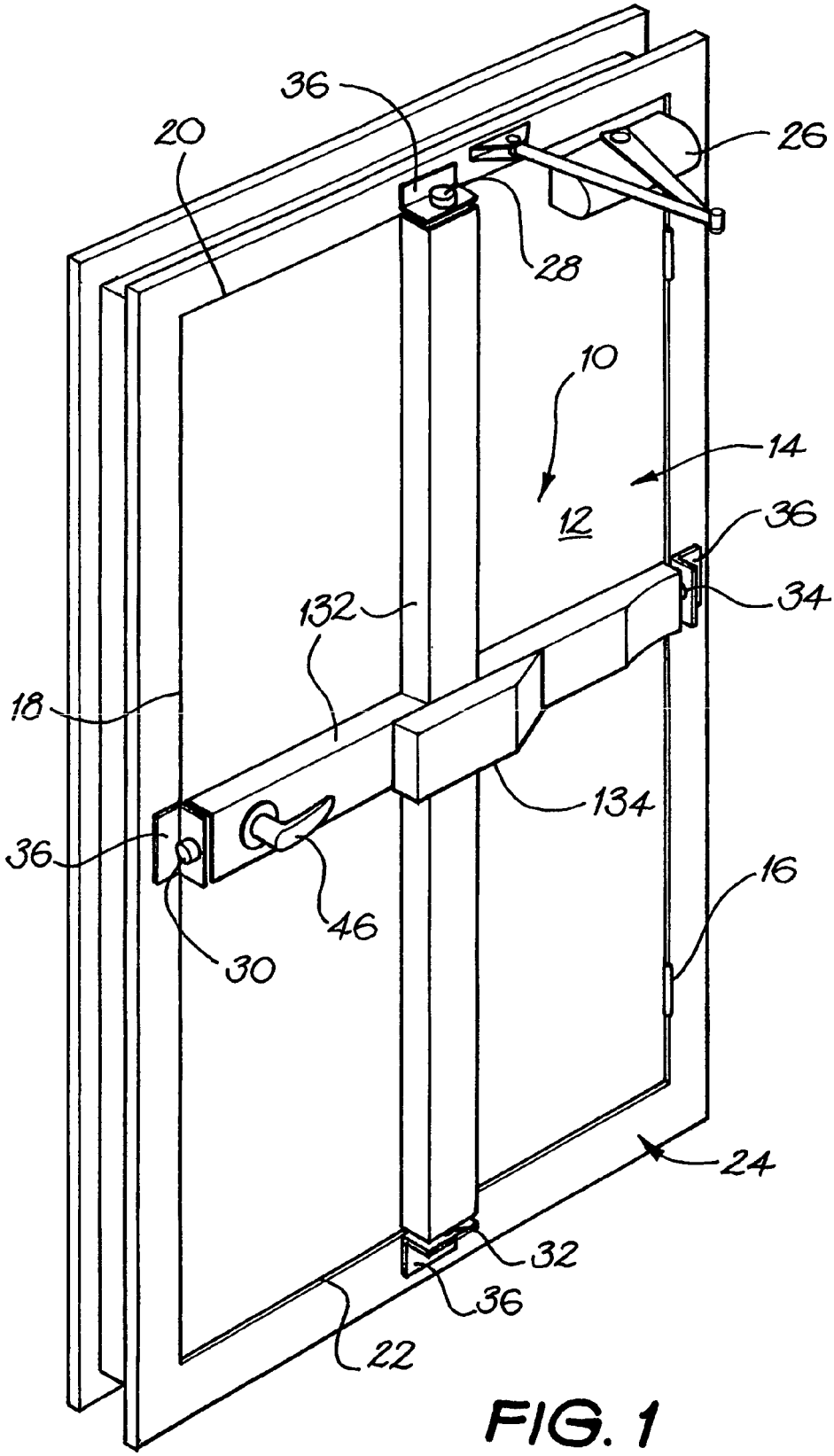
FIG. 1 shows a three dimensional view of a security lock arrangement, in accordance with an embodiment of the invention, mounted on a door.

In the drawings, reference numeral 10 generally designates a security lock arrangement, in accordance with an embodiment of the invention. For the sake of brevity, the security lock arrangement will be referred to as a "lock" or "security lock" in this description.

The security lock 10 is mounted on an operatively inner side 12 of a door 14. The door 14 has a hinge edge 16, a free edge 18, a top edge 20 and a bottom edge 22. The door is hinged to a frame 24 mounted in a reveal (not shown) of premises. A door closer 26 retains the door 14 in its closed position relative to the frame 24.

The security lock 10 has four latch bolts 28, 30, 32 and 34 for locking the door 14 in its closed position relative to the frame 24. Each latch bolt 28, 30, 32 and 34 is received in an opening in a striker plate 36 mounted on the frame 24.

Figure 2:
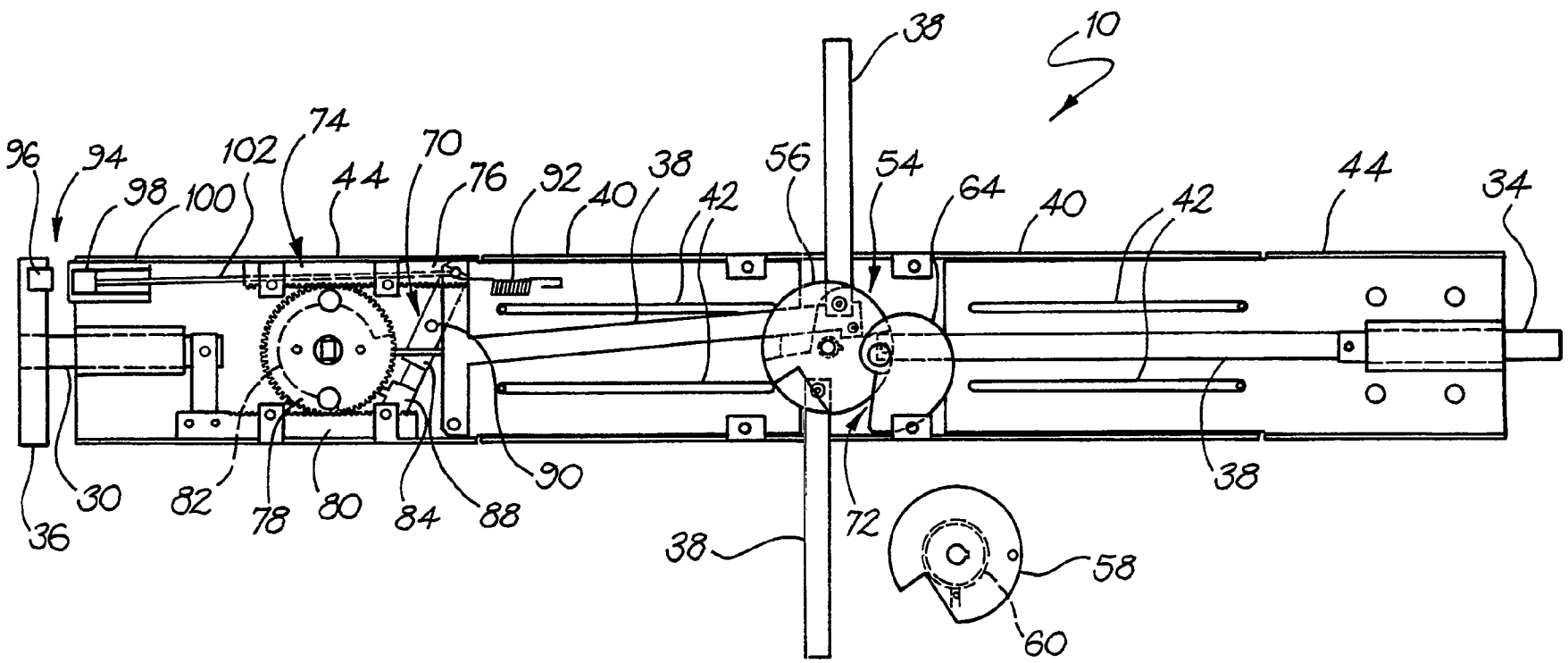
FIG. 2 shows a schematic, plan view of part of the security lock arrangement in its locked position.
Figure 3:
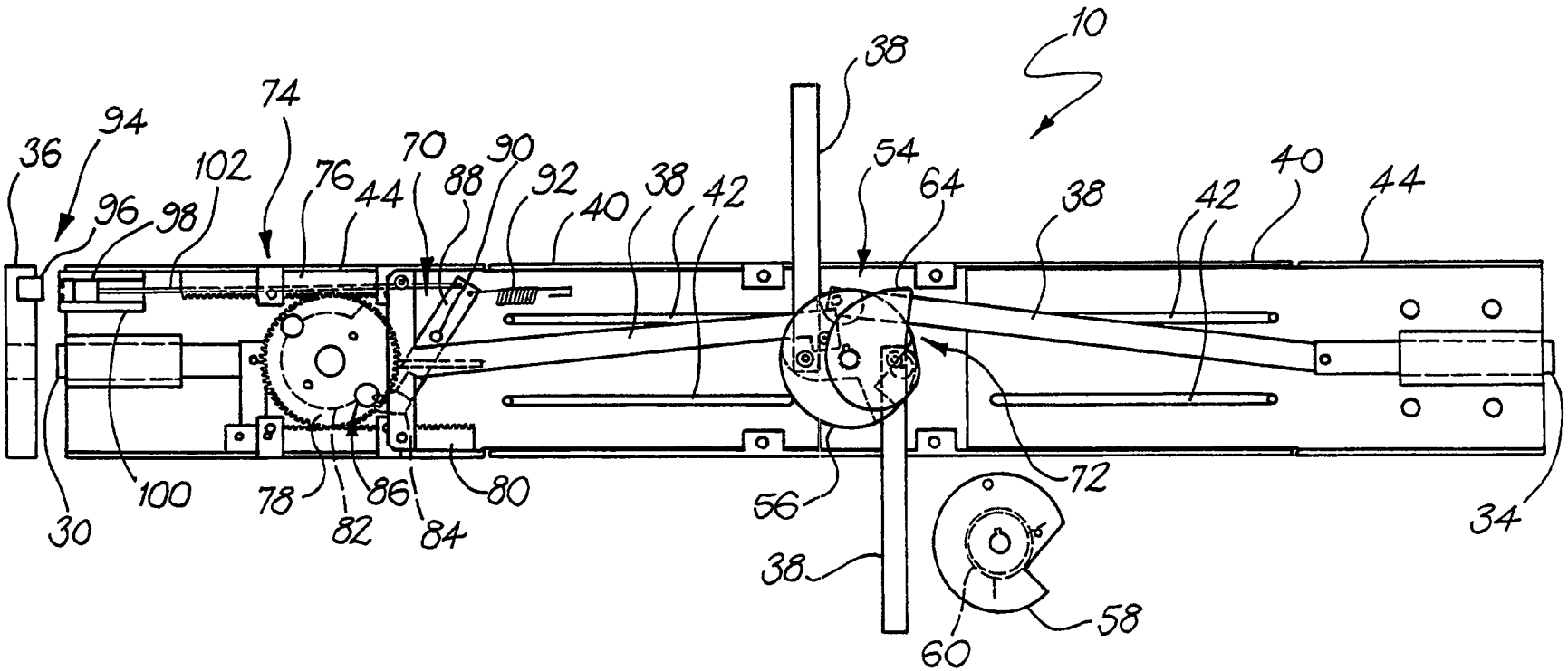
FIG. 3 shows a plan view of the security lock arrangement in its unlocked position.

Further, each latch bolt 28-34 is mounted to a control arm 38 (FIGS. 2 and 3). Each control arm 38 overlies a carrier in the form of a carrier plate 40. It is to be noted that the carrier plate 40 associated with the two vertical control arms 38 is omitted from FIGS. 2 and 3 of the drawings for the sake of clarity.

Each carrier plate 40 has a pair of slots 42 to permit sliding displacement of a segment 44 of each carrier plate 40 to cater for different heights and widths of door 14.

Figure 7:
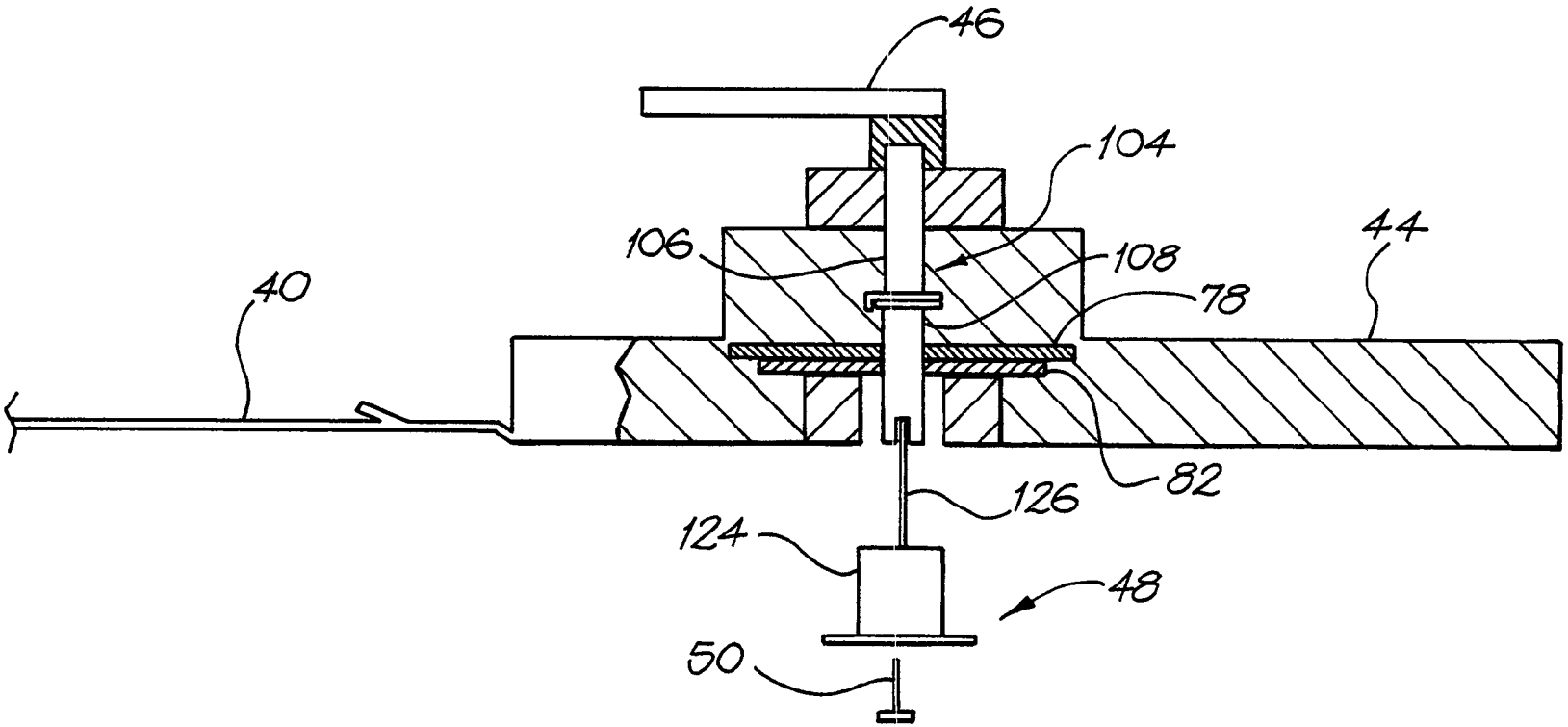
FIG. 7 shows a schematic plan view of still a further part of the security lock arrangement.

There are various ways of opening the door 14 relative to the frame 24 by unlocking the security lock 10. Thus, the security lock 10 includes a handle 46 (FIG. 1). A key lock 48 (FIG. 7), which will be described in greater detail below, is arranged on an opposed side of the door 14 for facilitating opening the door via a key 50.

In addition, electronic access, for example, via a keypad (not shown) is also possible. For this purpose, the security lock 10 includes a drive means in the form of an electric motor-gearbox combination 52 (FIGS. 4 and 5) for causing retraction of the latch bolts 28-34.

The motor-gearbox combination 52 drives the latch bolts 28-34 into their retracted, unlocked position in which they are free of the striker plates 36 allowing the door 14 to be opened relative to the frame 24. The motor of the combination 52 is controlled by an adjustable time delay mechanism (not shown). This time delay mechanism can be set by a user and typically has a time delay period of between about 3 seconds and 30 seconds. If the door 14 is not opened in that time, the motor-gearbox combination 52 allows the latch bolts 28-34 to return to their extended, locked positions.

More particularly, the motor-gearbox combination 52 drives a rotary element 54, to which inner ends of the control arms 38 are pivotally connected, through a predetermined arc of movement which is sufficient to retract the latch bolts 28-34.

The rotary element 54 comprises two rotary members 56 and 58 overlying an urging means in the form of a spirally wound spring 60 (FIG. 2), of the security lock 10. For the sake of clarity, the inner rotary element 58 is shown separately in FIGS. 2 and 3 of the drawings. In addition, it will be noted that only the control arm 38 associated with the latch bolt 34 is connected to the inner rotary member 58. The other control arms 38 are connected to the outer rotary member 56. The "inner" rotary member 58 is the one close to the carrier plate 40.

Figure 4:
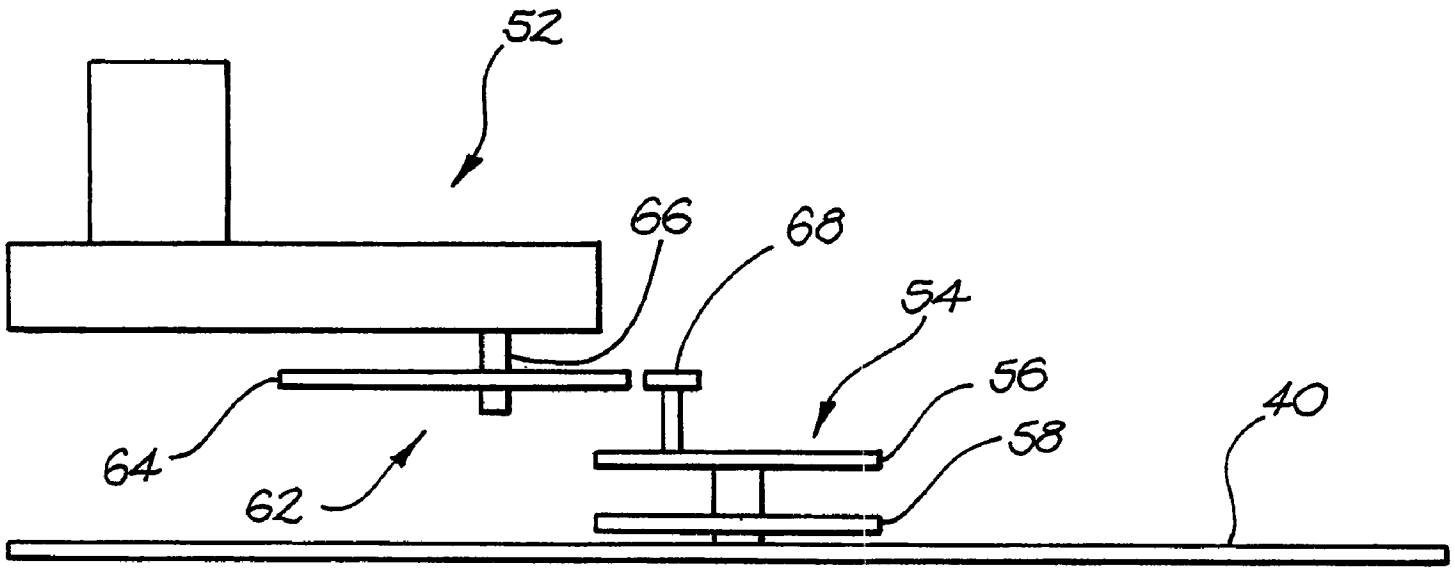
FIG. 4 shows a schematic, plan view of a further part of the security lock arrangement.
Figure 5:
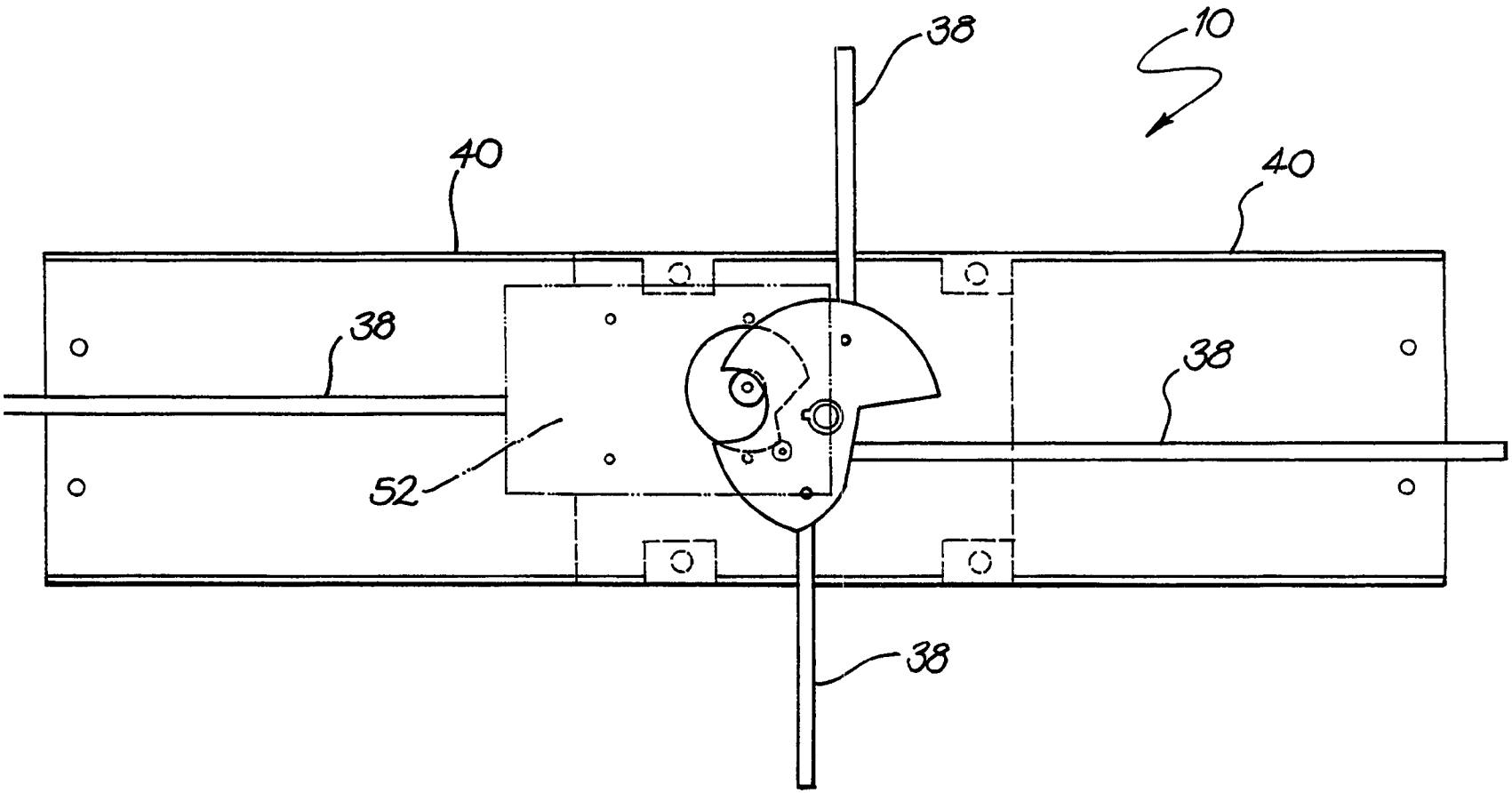
FIG. 5 shows a plan view of the part of FIG. 4.

As shown in greater detail in FIG. 4 of the drawings, the security lock 10 includes a displacement mechanism 62 interposed between the motor-gearbox combination 52 and the rotary element 54.

The displacement mechanism 62 comprises a cam 64 mounted on an output shaft 66 of the motor-gearbox combination 52. The cam 64 bears against a follower 68 which is eccentrically mounted on the rotary member 56 of the rotary element 54. When the motor of the combination 52 is operated, the cam 64 rotates and bears against the follower 68 causing rotation of the rotary element 54 from the position shown in FIG. 2 of the drawings to the position shown in FIG. 3 of the drawings. When the latch bolts 28-34 are in their fully retracted position as shown in FIG. 3 of the drawings, the cam 64 is at its maximum throw. It is also to be noted that the latch bolts 28-34 are retracted against the action of the spring 60 and the spring 60 is driven to the position shown in FIG. 3 of the drawings.

After the time delay period as set by the user has timed out, the motor continues rotating in the same direction to cause the cam 64 to move beyond its point of maximum throw relative to the follower 68. However, the latch bolts 34, if the door 14 is open relative to the frame 24, are retained in their retracted, unlocked positions by a holding means 70, as will be described in greater detail below. The cam 64 has a recessed region 72 (FIGS. 2 and 3) which lies substantially in register with the follower 68 after the cam 64 has moved beyond its position of maximum throw.

With this arrangement, it is ensured that, should the door 14 be in its closed position relative to the frame 24 and the time delay period times out, the latch bolts 28-34 move to their locked, extended positions.

The control arm 38 associated with the latch bolt 30 drives that latch bolt 30 via a positive displacement mechanism 74. The positive displacement mechanism 74 is a rack and pinion arrangement. One end of the control arm 38 is connected to a rack 76 which is displaceable parallel to the direction of movement of the latch bolt 30. Teeth of the rack 76 mesh with a pinion 78 rotatably mounted on the carrier plate 40 associated with the latch bolt 30. The latch bolt 30, in turn, is driven by the pinion 78 via a second rack 80 mounted on an opposite side of the pinion 78 to the rack 76.

Figure 6:
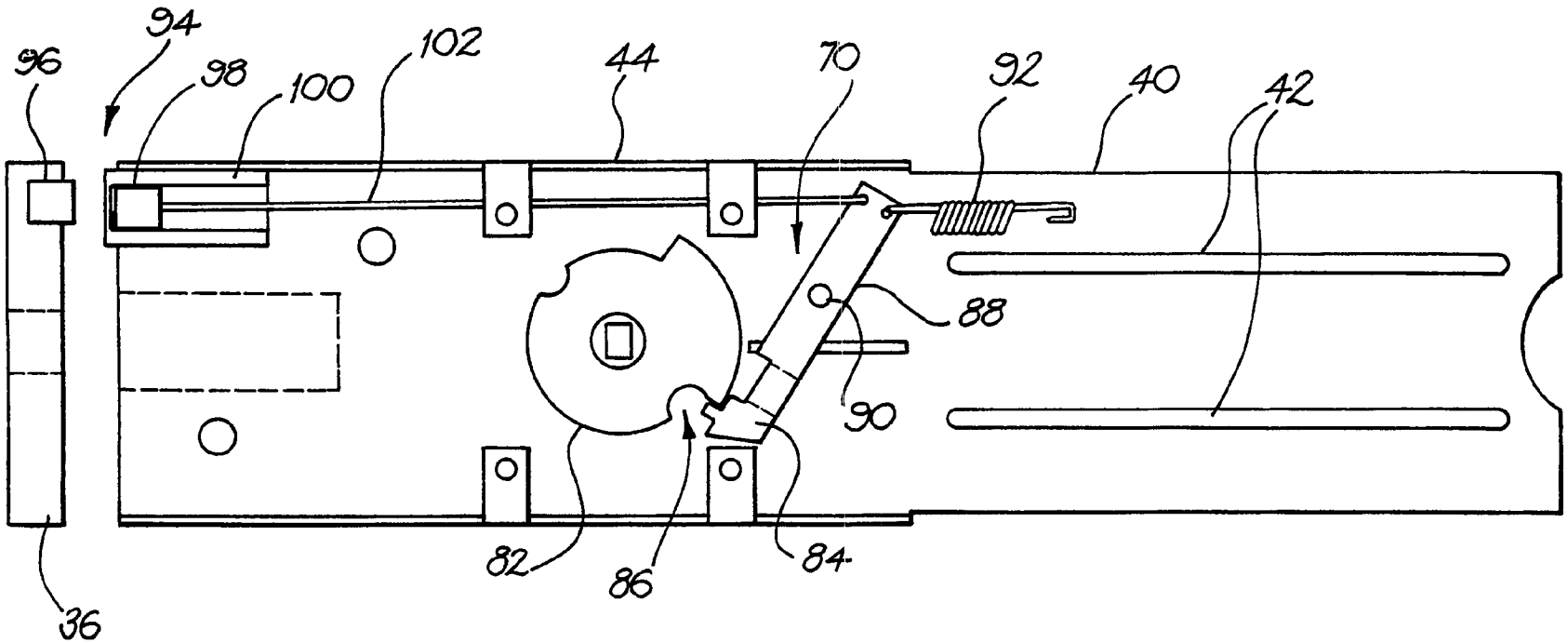
FIG. 6 shows a schematic plan view of yet a further part of the security lock arrangement.

A disk 82 (shown most clearly in FIG. 6 of the drawings) underlies the pinion 78 and is rotatably fast with the pinion 78.

The holding means 70 comprises a pawl 84 which, when the latch bolt 30 is in its retracted position, is received in a recessed formation 86. The pawl 84 is mounted at the end of an arm 88 which is pivotally mounted via a substantially centrally located pivot pin 90 to the carrier plate 40. The arm 88 is biased by a coil spring 92 into the position in which the pawl 84 engages the recess 86.

Hence, when the latch bolts 28-34 are withdrawn into their retracted, unlocked positions and the door 14 is in an open position relative to its frame 24, the disk 82 rotates from the position shown in FIG. 2 of the drawings to the position shown in FIG. 3 of the drawings. When the recess 86 comes into alignment with the pawl 84, the arm 88 rotates about the pin 90 under the action of the coil spring 92 driving the pawl 84 into the recess 86 and holding the disk 82 in that position. With this arrangement, the latch bolts 28-34 are retained in their retracted, unlocked positions. The latch bolts 28-34 will remain in this position for so long as the door 14 is held open relative to the frame 24.

The security door lock 10 includes a non-contact proximity detection unit 94 (FIGS. 2, 3 and 6) which senses when the door 14 is in its closed position relative to the frame 24. The proximity detection unit 94 is associated with the latch bolt 30 and includes a first magnet 96 mounted in the striker plate 36 of the latch bolt 30 and a second magnet 98 slideable piston-fashion in a cylinder 100 mounted at the end of the carrier plate 40 associated with the latch bolt 30.

The magnets 96 and 98 are strong magnets such as rare earth magnets.

The magnet 98 is connected to an end of the arm 88 opposite the end having the pawl 84 via a connector rod 102. When the pawl 84 engages the recess 86 of the disk 82 and holds the latch bolts 28-34 in their retracted position, the magnet 98 is, similarly, held in a retracted position relative to the cylinder 100. When the door 14 closes, and assuming the time delay of the motor-gearbox combination 52 has timed out so that the cam 64 no longer engages the follower 68, the magnet 96 attracts the magnet 98 from the position shown in FIG. 3 of the drawings to the position shown in FIG. 2 of the drawings. This causes the arm 88 to pivot relative to the pivot pin 90 against the action of the coil spring 92 pulling the pawl 84 out of engagement with the recess 86. When this occurs, the spiral spring 60 drives the rotary element 54 to cause the latch bolts 28-34 to be extended into their locked configuration in which they engage their associated striker plates 36. It will be appreciated that, if the time delay of the motor has timed out, the cam 64 is no longer in abutment with the follower 68 so that there is no longer any impediment to the spring 60 driving the latch bolts 28-34 to their locked positions.

Figure 8:
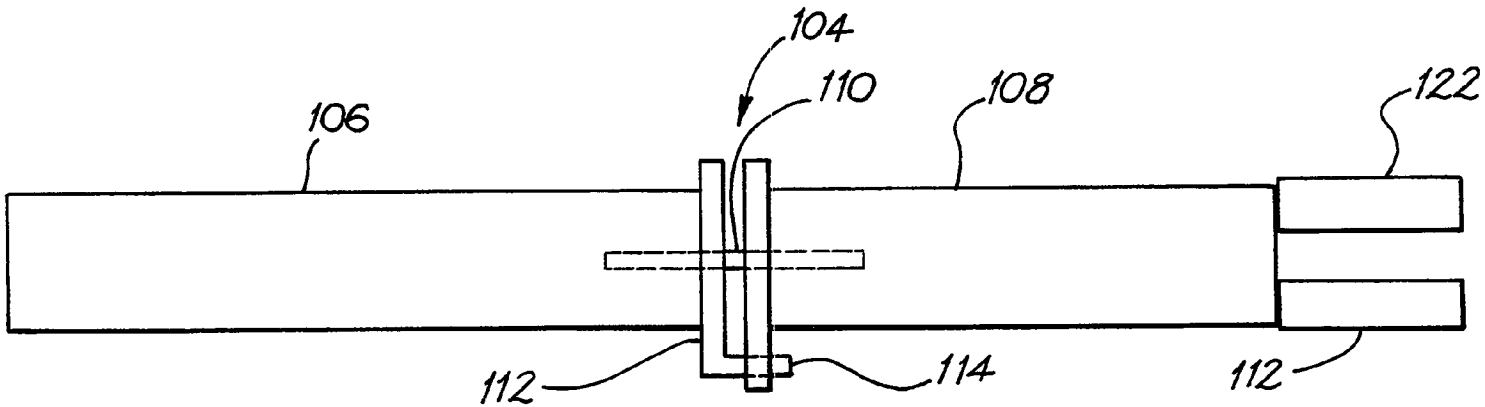
FIG. 8 shows a side view of a lost motion link of the part of FIG. 7.

The handle 46 of the security lock 10 is connected to the key lock 48 by means of a lost motion link 104. The link 104 is shown in greater detail in FIG. 8 of the drawings. The link 104 comprises a first spindle 106 to which the handle 46 is connected. A second spindle 108 is co-axially aligned with the spindle 106. The second spindle 108 is associated with the key lock 48.

The spindles 106 and 108 are connected together via an axle or pin 110 protruding into bores at facing, inner ends of the spindles 106, 108.

Figure 9:
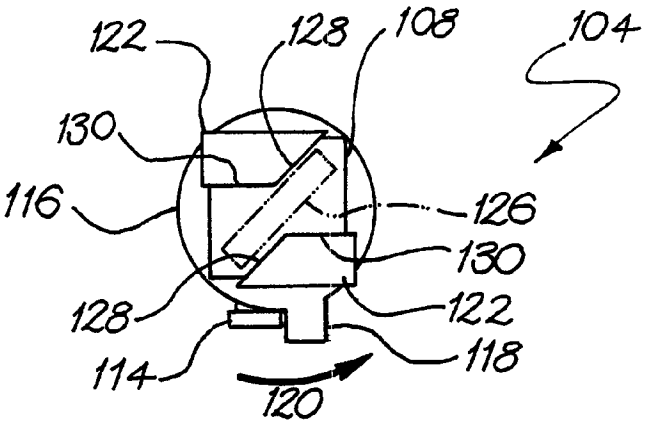
FIG. 9 shows an end view of the link.

The first spindle 106 has a drive member 112 at its inner end. The drive member 112 had a drive bar or finger 114 which extends in a direction parallel to a longitudinal axis of the spindle 106. The spindle 108 has a driven member 116 at its inner end and has a bearing formation 118 projecting radially outwardly from the driven member 116. The bearing formation 118 is engaged by the drive bar 114 of the spindle 106. Hence, when the handle 46 of the security lock 10 is rotated in the direction of arrow 120 (FIG. 9), both spindles 106 and 108 rotate. However, when the key 50 is used to unlock the security lock, the key 50 is also rotated in the direction of the arrow 120. It is to be noted that the bearing formation 118 moves out of engagement with the drive bar 114 so that only the spindle 108 rotates and less torque is required on the key 50 to unlock the security lock 10. Thus, the key lock 48 is, effectively, decoupled from the handle 46 via the lost motion link 104.

Also, for this purpose, an operatively outer end of the spindle 108 is bifurcated and is formed by a pair of opposed, spaced, staggered slot-defining bosses 122. A shown more clearly in FIG. 7 of the drawings, a barrel 124 of the key lock 48 engages the spindle 108 via a blade 126. The position of the blade 126 is shown in dotted lines in FIG. 9 of the drawings.

Each slot-defining boss 122 has a bevelled end to define a pair of lands 128 and 130 which have an obtuse included angle. At rest, the blade 126 bears against the lands 128. When the key 50 is used to unlock the security lock, the barrel 124 of the key lock 48 is rotated in the direction of the arrow 120 so that the blade 126 bears against the lands 128 causing the spindle 108 to rotate in the direction of the arrow 120. Conversely, bearing in mind that the barrel 124 is locked against rotation if the key 50 is removed, when the handle 46 is used to rotate the link 104, the spindle 108 rotates in the direction of the arrow 120 so that the blade 126 moves out of engagement with the lands 128 towards the lands 130 of the opposite bosses 122 allowing the spindle 108 to rotate freely relative to the blade 126 without being impeded by the locked barrel 124 of the key lock 48.

It is to be noted that the mechanism of the door lock 10 is covered by cover plates 132. In addition, the motor-gearbox combination 52 is covered by a cover plate 134 (FIG. 1).

It is, accordingly, an advantage of the invention that a security lock 10 is provided which allows the use of electronic access techniques without compromising the security of the lock 10. In addition, a non-contact proximity detection unit is provided for detecting when the door 14 is closed relative to the frame 24. The Applicant believes that this provides an improved level of security as it inhibits jamming of the latch bolts 28-34 into a retracted position. Still further, the use of the lost motion link 104 reduces the torque which needs to be imparted to the key 50 of a key lock 48 thereby reducing the risk of the key shearing or snapping in the barrel 124 of the key lock 48.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A security lock arrangement which includes:

a carrier to be mounted on a wing member;

at least two latch bolts extending in opposite directions displaceably arranged relative to the carrier between a retracted, unlocked position and an extended, locked position with each latch bolt having a carrier associated with it, each carrier being in the form of a carrier plate mountable to an operatively inner surface of the wing member;

an urging means acting on the at least one latch bolt for urging the latch bolt to its extended, locked position;

a drive means mounted on the carrier for driving at the least one latch bolt at least into its retracted position against the action of the urging means; and a displacement mechanism interposed between the drive means and the at least one latch bolt, the displacement mechanism comprising a cam member rotatably driven by the drive means, the cam member acting on a follower of the at least one latch bolt, the cam member having a maximum throw when the at least one latch bolt is proximate its retracted position.

2. The security lock arrangement of claim 1 which comprises two pairs of orthogonally arranged latch bolts.

3. The security lock arrangement of claim 2 in which the latch bolts are arranged in a cruciform-arrangement on the wing member and, when in their locked positions, project beyond edges of the wing member.

4. The security lock arrangement of claim 1 in which at least one carrier plate is arranged in segments to facilitate adjustment of the length of the carrier plate to cater for wing members of different sizes.

5. The security lock arrangement of claim 1 in which each latch bolt is mounted on a control arm, an operatively inner end of the control arm being pivotally secured to a rotary element arranged substantially centrally on the carrier plate.

6. The security lock arrangement of claim 5 in which the rotary element carries the follower, the follower being eccentrically arranged on the rotary element so that, when the cam rotates, it drives the rotary element through a predetermined arc to cause the control arms to be drawn inwardly to retract the latch bolts to their unlocked position.

7. The security lock arrangement of claim 5 in which the cam is arranged so that, when the latch bolts are in their retracted position, the follower is at a position of maximum throw of the cam.

8. The security lock arrangement of claim 6 in which a recessed region is arranged on a surface of the cam following the position of maximum throw so that, as the cam continues to rotate, the follower moves into register with such recessed region.

9. The security lock arrangement of claim 5 which includes a non-contact, proximity detection unit associated with at least one of the latch bolts for determining when the wing member is in its closed position relative to a surround of the wing member, the proximity detection unit, upon detecting that the wing member is closed, acting on a holding means to cause the holding means to disengage the at least one latch bolt so that the at least one latch bolt moves to its extended, locked position under the action of the urging means.

10. The security lock arrangement of claim 9 in which the control arm for the latch bolt associated with the proximity detection unit is connected to the latch bolt via a positive drive arrangement.

11. The security lock arrangement of claim 9 which includes a holding assembly for holding the at least one latch bolt in its retracted position.

12. The security lock arrangement of claim 11 in which the holding assembly is in the form of a pawl which engages a receiving formation associated with the positive drive arrangement.

13. The security lock arrangement in claim 12 in which the pawl is pivotally mounted on the carrier and is biased into engagement with the receiving formation.

14. The security lock arrangement of claim 12 in which the proximity detection unit comprises a magnetic assembly having a first magnet mounted in a wing member frame and a second magnet displaceably arranged relative to the carrier proximate a free edge of the wing member.

15. The security lock arrangement of claim 14 in which the second magnet is operatively associated with the pawl to act on the pawl so that, when the second magnet is attracted by the first magnet, when the wing member is in its closed position, the pawl is urged out of engagement with the receiving formation to release the latch bolts to enable the latch bolts to extend to be received in their respective striker plates under the action of the urging means.

16. The security lock arrangement of claim 1 which includes an operating mechanism which acts on the at least two latch bolts to withdraw the latch bolt from its locked position to its unlocked position, the operating mechanism comprising, in combination, a handle mountable on one side of the wing member and a key lock mechanism mountable on an opposed side of the wing member, the key lock mechanism including a barrel in register with a rotational axis of the handle, the barrel and the handle being connected by a link, the link including a lost motion component to allow the barrel and the handle to operate independently of each other.

17. The security lock arrangement of claim 16 in which the link connecting the handle and the barrel comprises a pair of co-axially aligned spindles interconnected by an axle or pin.

18. The security lock arrangement of claim 17 in which a first of the spindles is connected to the handle with the second of the spindles being associated with the barrel of the lock, the pin being arranged at facing, inner ends of the spindles.

19. The security lock arrangement of claim 17 in which the first spindle has a drive member on its inner end with the second spindle having a driven member on its second end on which the drive member acts.

20. The security lock arrangement of claim 17 in which the lost motion link includes a connecting formation at an outer end of the second spindle via which the barrel of the key lock is connected to the second spindle.

21. The security lock arrangement of claim 20 in which the connecting formation comprises a pair of opposed, spaced slot-defining members at an outer end of the second spindle, the slot-defining members having shaped surfaces so that, when the second spindle is rotated under the effect of the handle, the slot-defining members can rotate relative to a component of the key look without impinging on the component but, when the key lock is used to unlock the security look arrangement, the component bears against the slot-defining members to cause rotation of the second spindle only.

22. A security lock arrangement which includes:

a carrier to be mounted on a wing member;

at least one latch bolt displaceably arranged relative to the carrier between a retracted, unlocked position and an extended, locked position;

an urging means acting on the at least one latch bolt for urging the latch bolt to its extended, locked position;

a displacement mechanism for displacing the at least one latch bolt at least to its retracted, unlocked position against the action of the urging means;

a holding assembly for holding the at least one latch bolt in its retracted position; and a non-contact, proximity detection unit for determining when the wing member is in its closed position relative to a surround of the wing member, the proximity detection unit, upon detecting that the wing member is closed, acting on the holding assembly to cause the holding assembly to disengage the at least one latch bolt so that the at least one latch bolt moves to its extended, locked position under the action of the urging means.

23. The security lock arrangement of claim 22 which comprises at least two latch bolts extending in opposite directions.

24. The security lock arrangement of claim 23 which comprises two pairs of orthogonally arranged latch bolts.

25. The security lock arrangement of claim 24 in which the latch bolts are arranged in a cruciform-arrangement on the wing member and, when in their locked positions, project beyond edges of the wing member.

26. The security lock arrangement of claim 23 in which each latch bolt has a carrier associated with it, each carrier being in the form of a carrier plate mountable to an operatively inner surface of the wing member.

27. The security lock arrangement of claim 26 in which at least one carrier plate is arranged in segments to facilitate adjustment of the length of the carrier plate to cater for wing members of different sizes.

28. The security lock arrangement of claim 26 in which each latch bolt is mounted on a control arm, an operatively inner end of the control arm being pivotally secured to a rotary element arranged substantially centrally on the carrier plate.

29. The security lock arrangement of claim 28 in which the control arm for the latch bolt associated with the proximity detection unit is connected to the latch bolt via a positive drive arrangement.

30. The security lock arrangement of claim 23 in which the holding assembly is in the form of a pawl which engages a receiving formation associated with the positive drive arrangement.

31. The security lock arrangement of claim 30 in which the pawl is pivotally mounted on the carrier and is biased into engagement with the receiving formation.

32. The security lock arrangement of claim 30 in which the proximity detection unit comprises a magnetic assembly having a first magnet mounted in a wing member frame and a second magnet displaceably arranged relative to the carrier proximate a free edge of the wing member.

33. The security lock arrangement of claim 32 in which the second magnet is operatively associated with the pawl to act on the pawl so that, when the second magnet is attracted by the first magnet, when the wing member is in its closed position, the pawl is urged out of engagement with the receiving formation to release the latch bolts to enable the latch bolts to extend to be received in their respective striker plates under the action of the urging means.

34. The security lock arrangement of claim 22 which includes an operating mechanism which acts on the at least one latch bolt to withdraw the latch bolt from its locked position to its unlocked position, the operating mechanism comprising, in combination, a handle mountable on one side of the wing member and a key lock mechanism mountable on an opposed side of the wing member, the key lock mechanism including a barrel in register with a rotational axis of the handle, the barrel and the handle being connected by a link, the link including a lost motion component to allow the barrel and the handle to operate independently of each other.

35. The security lock arrangement of claim 34 in which the link connecting the handle and the barrel comprises a pair of co-axially aligned spindles interconnected by an axle or pin.

36. The security lock arrangement of claim 35 in which a first of the spindles is connected to the handle with the second of the spindles being associated with the barrel of the lock, the pin being arranged at facing, inner ends of the spindles.

37. The security lock arrangement of claim 35 in which the first spindle has a drive member on its inner end with the second spindle having a driven member on its second end on which the drive member acts.

38. The security lock arrangement of claim 35 in which the lost motion link includes a connecting formation at an outer end of the second spindle via which the barrel of the key lock is connected to the second spindle.

39. The security lock arrangement of claim 38 in which the connecting formation comprises a pair of opposed, spaced slot-defending members at an outer end of the second spindle, the slot-defining members having shaped surfaces so that, when the second spindle is rotated under the effect of the handle, the slot-defining members can rotate relative to a component of the key lock without impinging on the component but, when the key lock is used to unlock the security lock arrangement, the component bears against the slot-defining members to cause rotation of the second spindle only.

40. A security lock arrangement which includes:

a carrier to be mounted on a wing member;

at least two latch bolts extending in opposite directions displaceably arranged relative to the carrier between a retracted, unlocked position and an extended, locked position with each latch bolt having a carrier associated with it, each carrier being in the form of a carrier plate mountable to an operatively inner surface of the wing member;

an urging means acting on the at least one latch bolt for urging the latch bolt to its extended, locked position; and an operating mechanism which acts on the at least one latch bolt to withdraw the latch bolt from its locked position to its unlocked position, the operating mechanism comprising, in combination, a handle mountable on one side of the wing member and a key lock mechanism mountable on an opposed side of the wing member, the key lock mechanism including a barrel in register with a rotational axis of the handle, the barrel and the handle being connected by a link, the link including a lost motion component to allow the barrel and the handle to operate, at least partially, independently of each other.

41. The security lock arrangement of claim 40 which comprises two pairs of orthogonally arranged latch bolts.

42. The security lock arrangement of claim 41 in which the latch bolts are arranged in a cruciform-arrangement on the wing member and, when in their locked positions, project beyond edges of the wing member.

43. The security lock arrangement of claim 40 in which at least one carrier plate is arranged in segments to facilitate adjustment of the length of the carrier plate to cater for wing members of different sizes.

44. The security lock arrangement of claim 40 in which each latch bolt is mounted on a control arm, an operatively inner end of the control arm being pivotally secured to a rotary element arranged substantially centrally on the carrier plate.

45. The security lock arrangement of claim 40 in which the link connecting the handle and the barrel comprises a pair of co-axially aligned spindles interconnected by an axle or pin.

46. The security lock arrangement of claim 45 in which a first of the spindles is connected to the handle with the second of the spindles being associated with the barrel of the lock, the pin being arranged at facing, inner ends of the spindles.

47. The security lock arrangement of claim 45 in which the first spindle has a drive member on its inner end with the second spindle having a driven member on its second end on which the drive member acts.

48. The security lock arrangement of claim 45 in which the lost motion link includes a connecting formation at an outer end of the second spindle via which the barrel of the key lock is connected to the second spindle.

49. The security lock arrangement of claim 48 in which the connecting formation comprises a pair of opposed, spaced slot-defining members at an outer end of the second spindle, the slot-defining members having shaped surfaces so that, when the second spindle is rotated under the effect of the handle, the slot-defining members can rotate relative to a component of the key lock without impinging on the component but, when the key lock is used to unlock the security lock arrangement, the component bears against the slot-defining members to cause rotation of the second spindle only.

* * * * *

UNITED STATES PATENT AND TRADEMARK OFFICE

CERTIFICATE OF CORRECTION

PATENT NO. : 7,591,157 B2
APPLICATION NO. : 10/595417
DATED : September 22, 2009
INVENTOR(S) : O'Neill et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 555 days.

Signed and Sealed this

Twenty-first Day of September, 2010

David J. Kappos

David J. Kappos
*Director of the United States Patent and Trademark Office*